US005186701A

United States Patent [19]

Wilkinson

[11] Patent Number: 5,186,701

[45] Date of Patent: Feb. 16, 1993

[54] AEROBIC RESISTANCE EXERCISE GARMENT

[76] Inventor: William T. Wilkinson, 1717 Town Point Rd., Chesapeake City, Md. 21915

[21] Appl. No.: 788,364

[22] Filed: Nov. 6, 1991

Related U.S. Application Data

[63] Continuation-in-part of Ser. No. 746,900, Aug. 19, 1991.

[51] Int. Cl.[5] ..... A63B 21/02

[52] U.S. Cl. ..... 482/125; 482/121; 482/122; 482/124

[58] Field of Search ..... 482/121, 122, 124, 125

[56] References Cited

U.S. PATENT DOCUMENTS

| | | | |
|---|---|---|---|
| 843,478 | 2/1907 | Muller | 482/124 |
| 866,495 | 9/1907 | Marks | 482/124 |
| 1,402,179 | 1/1922 | Piscitelli | 482/124 |
| 1,618,273 | 10/1921 | Davidson . | |
| 1,669,499 | 5/1928 | Titus | 482/122 |
| 2,035,010 | 3/1936 | Rawlings | 482/124 |
| 2,097,376 | 7/1936 | Marshman . | |
| 2,613,932 | 10/1956 | Manners | 482/124 |
| 4,047,714 | 9/1977 | Powell | 482/131 |
| 4,060,240 | 11/1977 | Dunston | 482/131 |
| 4,065,814 | 1/1978 | Fox | 482/124 |
| 4,245,840 | 1/1981 | Van Housen | 482/124 |
| 4,815,729 | 3/1989 | Stefanski . | |
| 4,910,802 | 3/1990 | Malloy | 482/124 |
| 5,109,546 | 5/1992 | Dicker . | |

FOREIGN PATENT DOCUMENTS

| | | | |
|---|---|---|---|
| 0030562 | 11/1907 | Austria | 482/124 |
| 0367748 | 1/1923 | Fed. Rep. of Germany | 482/124 |
| 0449168 | 9/1927 | Fed. Rep. of Germany | 482/124 |

OTHER PUBLICATIONS

Self Magazine, Sarah Gallop, *Tommorrow's Workout Ger Today,* Sep. 1991.

*Primary Examiner*—Richard J. Apley
*Assistant Examiner*—Lynne Reichard
*Attorney, Agent, or Firm*—Connolly & Hutz

[57] ABSTRACT

An aerobic resistance exercise garment effectively supplements a motion exercise. The garment includes an article of clothing worn on the body with an anchor member worn at the hand or foot. A connecting element is connected to the article of clothing and the anchor member. The connecting element is preferably made of an elastic material so as to offer resistance during the movement of the arm or leg in a motion exercise.

19 Claims, 5 Drawing Sheets

AEROBIC RESISTANCE EXERCISE GARMENT

CROSS-REFERENCE TO RELATED APPLICATION

This application is a continuation-in-part of co-pending application Ser. No. 07/746,900 filed Aug. 19, 1991 pending.

BACKGROUND OF INVENTION

There is currently a growing demand for convenient low impact aerobic exercise that is rigorous and of varying intensity. Generally, various aerobic exercises have included arm and leg motions. The aerobic exercise is varied by exercising at a faster pace; exercising for a longer period of time; and moving the body, arms and/or legs more vigorously while exercising using weights on the arms, hands or body and using resistance bands or cords for the arms.

It would be desirable if the main aerobic motion exercise could be enhanced by a supplemental exercise wherein resistance is encountered during the normal movement of the arms and/or legs while participating in the main exercise program.

It has been suggested as disclosed in U.S. Pat. No. issued to Stephen I. Block to provide an exercise device in the form of a belt worn around the waist of the user with elastic cords mounted at one end to the belt and held at the other end by the hands. It has also been suggested to provide a garment which is laced with long, thin rubber bands that provide a workout whenever the wearer moves.

SUMMARY OF INVENTION

An objection of this invention is to provide an aerobic resistance exercise garment which supplements a main aerobic motion exercise in a manner that fulfills the above needs.

In accordance with a preferred practice of this invention the aerobic resistance exercise garment includes an article of clothing worn on the body. An anchor member such as a glove or shoe is worn on the hands or feet. Connecting elements which are preferably elastic cords connect the article of clothing with the gloves and/or shoes.

The invention may be practiced with many variations. For example, the connecting elements need not be elastic. Rather the resistance could be provided by having sections of the articles of clothing elastic. The articles of clothing could be an entire body suit or could be a partial article of clothing such as a harness or a mesh type vest. The cords could be attached to various parts of the body, such as the waist, shoulders, and back as well as to the arms and legs.

In a further variation of the invention, an entire body suit may be provided with elastic sections and the arms or legs portions of the suit may terminate in adjustable straps which could be held by the hands or disposed around the feet so that the hands or feet still function as anchor members.

THE DRAWINGS

DETAILED DESCRIPTION

Figure 1:
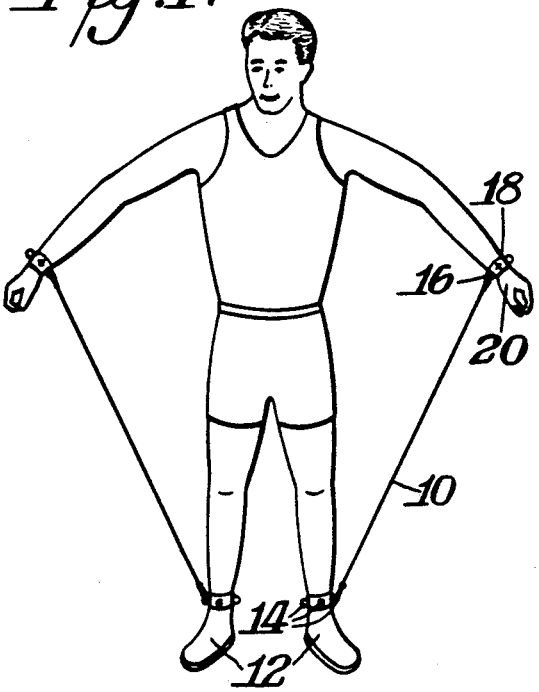
FIG. 1 is a front elevational view of one form of practice of the invention.

In general, the invention provides a specially designed body suit that allows a system of webs or elastic cords to be worn over it, attached to it, or inserted through it. Anchor members are provided at the limb extremities such as the hands or feet to anchor an end of the elastic portions of the body suit so as to offer resistance during the motions that occur when performing a main exercise. The various components acting together form a piece of clothing that can enhance a main exercise in, for example, the following ways:

1. One or more elastic cords can be attached to the suit to create resistance to motion;
2. The cords can be attached to different portions of the suit to permit upper body, lower body or total body exercise;
3. The cords can be of adjustable or fixed lengths to fit al sizes of people;
4. The cords can be of varying tensions/resistances to give different levels of workout and accommodate persons of different strengths;
5. The suit can have permanent or detachable gloves to fixed cords for arms exercises;
6. The suit can have guides/loops to position the elastic cords for resistance to various parts of the body and for various types of sport or motion;
7. The guides can be permanent or detachable;
8. The suit can have a special guide belt around the waist;
9. The guides can be located anywhere, but preferably are on the arms, wrists, shoulders, chest, waist, legs, knees, back and ankles;
10. The suit legs can have stirrups for the feet or the cords can attach over the shoe by a spat or loop or by a specially designed shoe with spaces for attaching cords such as by having clips, eyelets or loops at the cord attaching locations;
11. The suit could have panels or elastic webs joining the arms to the body, joining the arms to the arms or joining the legs to each other;

12. The guides can have a padded back to insulate the body from sliding friction and pressure of the elastic cords;
13. The elastic cords can run on the front, back or side of the body;
14. By varying the number, length, strength or position of the elastic cords the user can adjust resistance to individual preferences and tune "the suit for a particular sport, exercise or motion";
15. The guides can have eyelets or holes for cord attachment.

In general the resistance garment includes a suit with guides or loops and some form of detachable fasteners, such as clips, eyelets or hooks for detachably mounting elastic cords. Additionally, gloves may be provided to anchor some of the cords to the hands. Similarly, other cords may be detachably attached to the shoes. The adjustable length of the elastic cords provides for varying strengths with means to attach the cords to the suit, gloves or shoes.

In the preferred practice of the invention the cords are arranged in mirror image fashion on each side of the body when viewed from head to foot.

In the practice of the invention wherein the cords are anchored to the feet, it is preferable to use suitable footwear. The cords can be connected to the footwear in three basic ways. In one way the connection is directly to the footwear with the shoe having connecting devices such as eyelets, loops or hooks to which the elastic cords or the suit legs may be secured. An alternative would be to fasten the cords over the shoes by a spat or loop which is disposed around the shoe or footwear. A third alternative would be to insert the cords around the foot inside the shoe or footwear using a loop or stirrup.

Where the invention is practiced using the hands as the anchoring location different variations could be used. In one variation the cords or suit arms could be attached directly to a glove where the glove includes fastening elements such as eyelets, loops or hooks to which the cords or suit arms would be fastened. A further alternative would be to dispose the cords or suit arms over the gloves by a loop going around the gloves or finger portions of the glove. A further alternative would be to dispose the cords or arm loops over the hand with the glove being worn over the cords or arm loops.

In a desirable practice of the invention fasteners are used which could be conveniently operated to detachably secure the cords or suit arms/legs to the gloves, hands, shoes or feet. Suitable fastening devices includes hooks, clips, straps/buckles, snaps, velcro, bands, loops and eyelets. Such fastening devices may be elastic, but are preferably non-elastic so as to limit the flex/resistance variable to solely the length and/or strengths of the cords or the suit. The fastening devices may be adjustable but are preferably non-adjustable again to limit the resistance variable to the elastic cords and/or suit.

Where elastic cords are used the cords may be attached to the outer portion of the article of clothing or suit. Alternatively, the cords could be attached to a vest or harness worn under the suit. A further variation would be to locate the cords within the suit itself, such as between layers or a multi-layer suit with the cords or the elastic portions of the suit anchored to the limb extremity.

It is to be understood that when the term cord is used with regard to the practice of the invention such term is used in its broadest sense and includes not only cords or circular cross-section but also flat type cords or strips.

Similarly, it is to be understood that when the invention refers to shoes or footwear, any suitable footwear may be used including conventional shoes, sneakers, low cut or high tops, as well as ice skates, roller skates, roller blades or shoes having cleats. As later described, such specialized footwear would ordinarily be used in specific main aerobic exercises where it is desirable to supplement the exercise by use of the resistance garment of this invention.

FIG. 1 illustrates a basic practice of the invention wherein elastic cords 10 are secured to anchor members on the hands and feet. As illustrated, for example, shoes 12 are provided with spaced loops 14 with one end of cord 10 being attached to a selected loop 14. The provision of spaced loops offers selectivity in the resistance encountered from cord 10. The other end of cord 10 is attached to a selected loop 16 on the cuff portion 18 of a glove 20.

Figure 2:
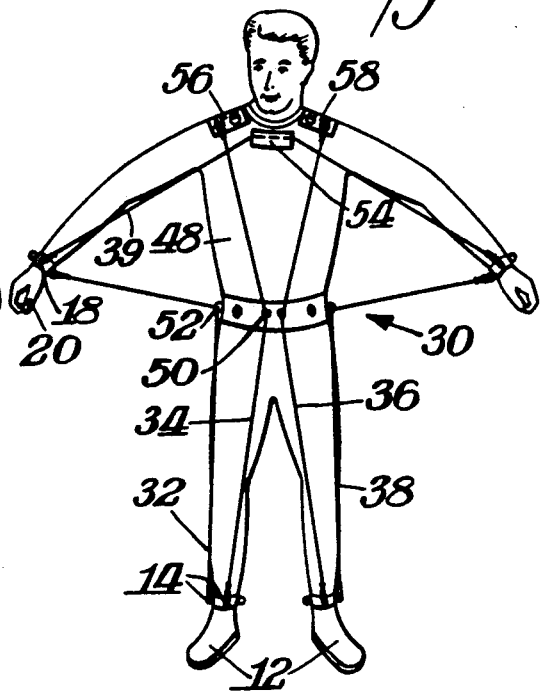
FIG. 2 is a front elevational view of a further embodiment of this invention.
Figure 3:
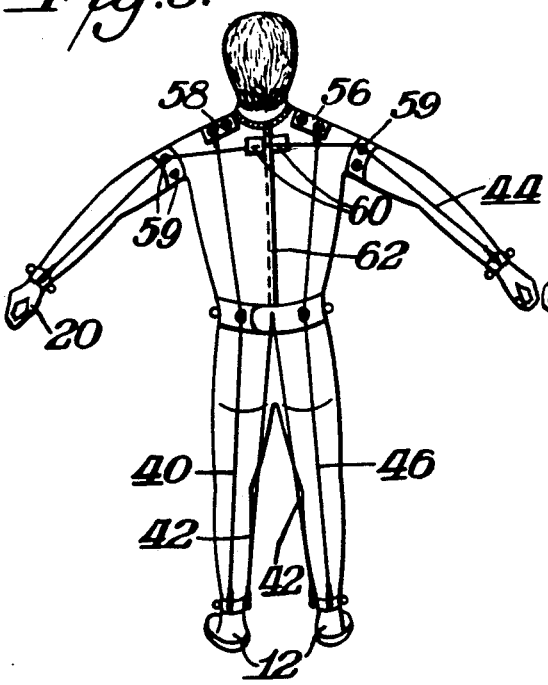
FIG. 3 is a rear elevational view of the embodiment of the invention shown in FIG. 2.

FIGS. 2–3 illustrate an aerobic resistance garment 30 which employs more of the concepts of this invention than does the device of FIG. 1. As shown in FIGS. 2-3 shoes 12 include loops 14 to which various cords 32, 34, 36, 38, 39, 40, 42, 44, 46 are attached. The garment 48 is in the form of a full suit having a belt 50 with a series of loops or guides 52. As shown in FIG. 3 belt 50 is adjustable in length. Additionally, a tunnel or guide 54 is provided in the chest section while the shoulders include reinforcing strips with a series of loops or fasteners 56 on one shoulder and 58 on the other shoulder. The back of the garment includes tunnels or guides 60 and additional loops 56,58. Cuffs or reinforcing bands are provided near the shoulders with loops 59.

Garment 48 may be attached in any suitable manner, such as by the provision of a zipper 62 along the back.

As is apparent, FIGS. 2–3 the various cords may be attached in any suitable manner to provide a variety of different resistances to develop different muscles. For example, cord 32 is anchored at one end to shoe 12 and passes through loop 52 on belt 50 with the opposite end being anchored to loop 18 of glove 20. Cord 34 is anchored to shoe 12, passes through a loop 52 on belt 50 and is anchored to shoulder loop 56. Similarly, cord 36 is anchored to the opposite shoe 12 and passes through a loop belt 50 with the upper end being anchored to shoulder loop 58. A further cord 38 is anchored to shoe 12, passes through a loop on belt 50 and is anchored at its opposite end to glove 20. As shown in FIG. 3, cords 40-46 are anchored to shoes 12 and are connected to respective shoulder loops 58,56. Cord 42 is anchored at one end to one shoe 12, passes through a loop on belt 50 and then is anchored at its opposite end to the other shoe 12. Cord 44 extends from one hand to another by each end being anchored to loops on gloves 20 with the cord 44 passing through loops 59 near the shoulders and passes through tunnels or guides 60. Cords 39 and 44 which are anchored to the gloves provide an effective pull across the shoulders.

Figure 4:
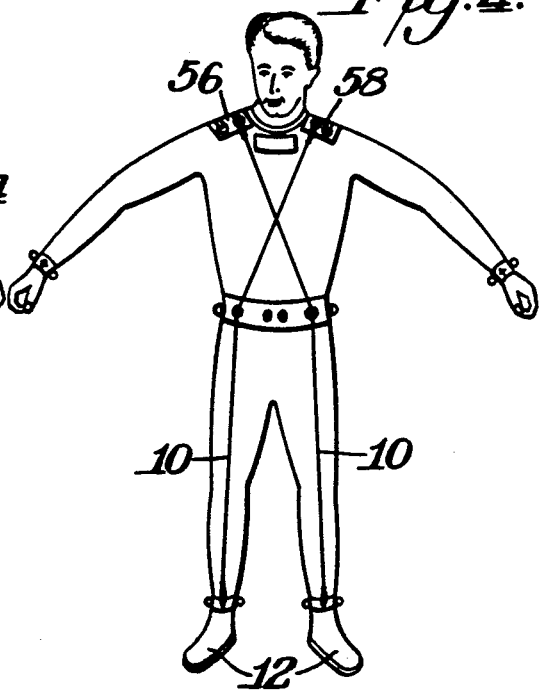
FIGS. 4–5 are front elevational views of yet further practices of the invention.

FIG. 4 illustrates a variation wherein a pair of cords 10 are anchored to respective shoes 12, pass through loops on belt 50, criss-cross on the user's chest and then are anchored at respective shoulder loops 56,58.

Figure 5:
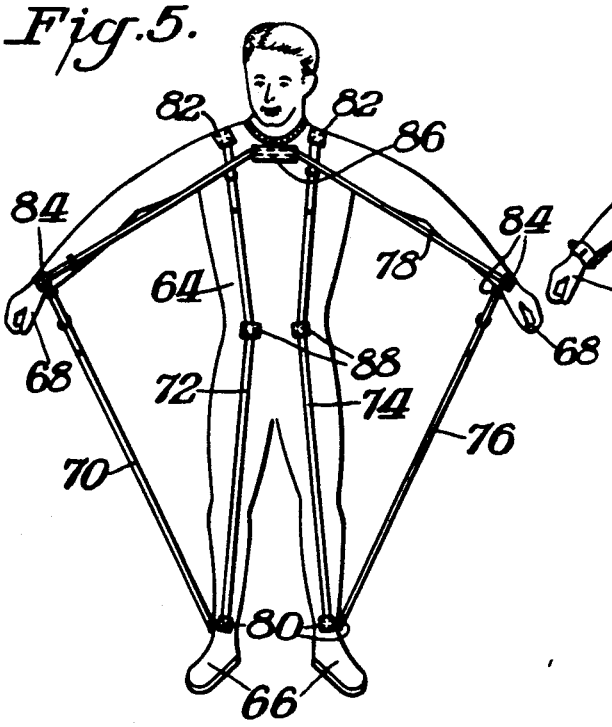

FIG. 5 illustrates a variation of the invention wherein a one piece body suit 64 includes integral footwear sections 66 and integral glove sections 68. As illustrated a plurality of cords 70, 72, 74, 76, 78 are provided. The cords are permanently anchored at foot locations 80, shoulder locations 82 and hand locations 84. The cords are also disposed through tunnels or guides 86,88.

Figure 6:
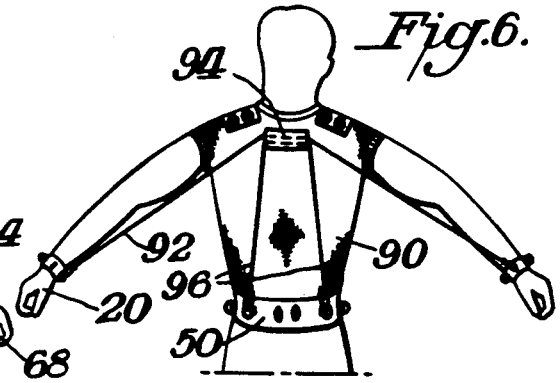
FIGS. 6–7 are front elevational views of modified garments in accordance with the invention.

FIG. 6 illustrates a variation of the invention wherein the article of clothing 90 is made of an elastic or stretchable material, such as a mesh or spandex type material. Gloves 20 have non-elastic cords 92 anchored at each end and extending through guide or tunnel 94. A second non-elastic cord 96 is anchored to belt 50 at both ends and passes through the same guide 94 as non-elastic cord 92.

Figure 7:
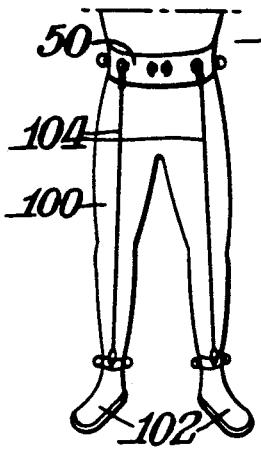

FIG. 7 illustrates a further variation wherein a lower body garment or pants 100 is provided with shoes 102 which may be separate or integral and a belt 50. Cords 104 are anchored at one end to shoes 102 and at the other end to belt 50.

Figure 8:
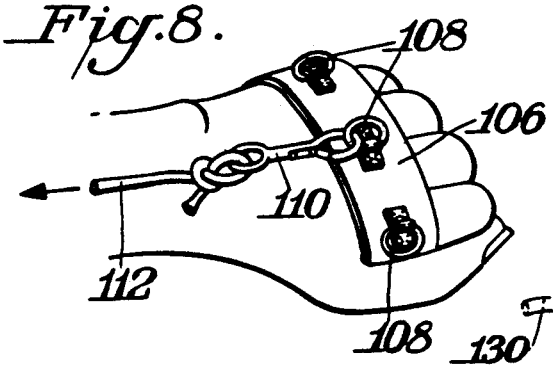
FIG. 8 is a perspective view of a hand anchor member in accordance with this invention.

FIG. 8 illustrates a variation of the invention wherein a hand grip 106 is utilized instead of or beneath a glove. Hand grip 106 may be, for example, a leather strap held around the fingers in the manner illustrated. Hand grip 106 would include a series of loops 108 having a conventional spring fastener 110 attached to cord 112 so that cord 112 may be detachably secured to hand grip 106 at any of the locations provided by loops 108.

Figure 9:
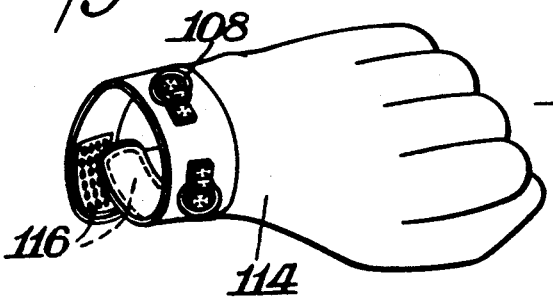
FIG. 9 is a perspective view of a glove used as an anchor member in accordance with this invention.

FIG. 9 illustrates a variation wherein a glove 114 includes loops 108 and is adjustably connected by means of velcro fasteners 116 in the wrist area.

Figure 10:
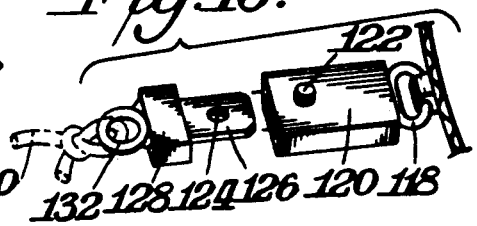
FIGS. 10–11 are perspective views of various detachable fastening means in accordance with this invention.

FIG. 10 illustrates a convenient form of clip fastener for the shoes, gloves, belt, etc. which includes a loop 118 permanently secured to the anchoring member with a housing 120 permanently secured to loop 118. A spring pin 122 is provided in housing 120 for securement into hole 124 of tongue 126 on connector 128 with cord 130 being secured to loop 132 permanently mounted to loop 128.

Figure 11:
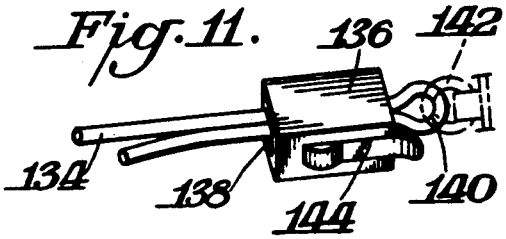

FIG. 11 shows a further variation which provides adjustability of length for cord 134 by means of a housing 136 having a passage 138 through which cord 134 extends with the projecting portion 140 of cord 134 forming a loop fitting through fixed loop 142. A cam member 144 locks cord 134 in place in a known manner.

Figure 12:
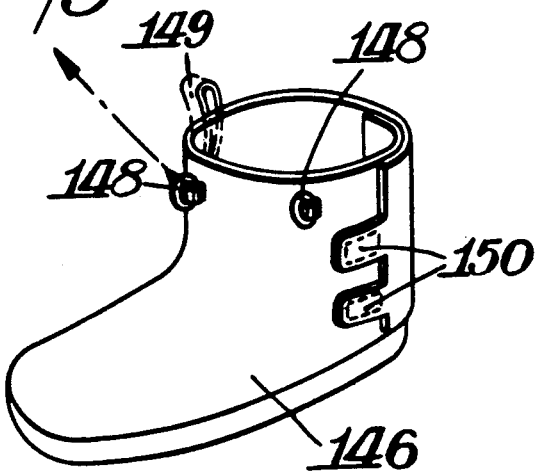
FIGS. 12–14 are perspective views of various footwear in accordance with this invention.
Figure 13:
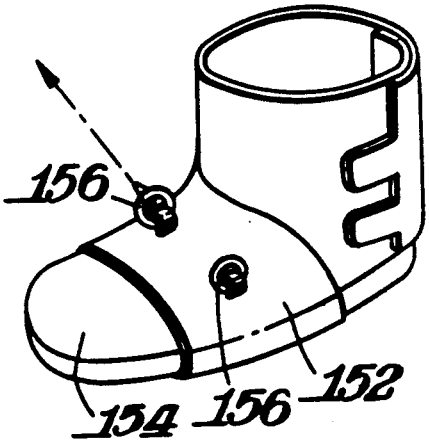
Figure 14:
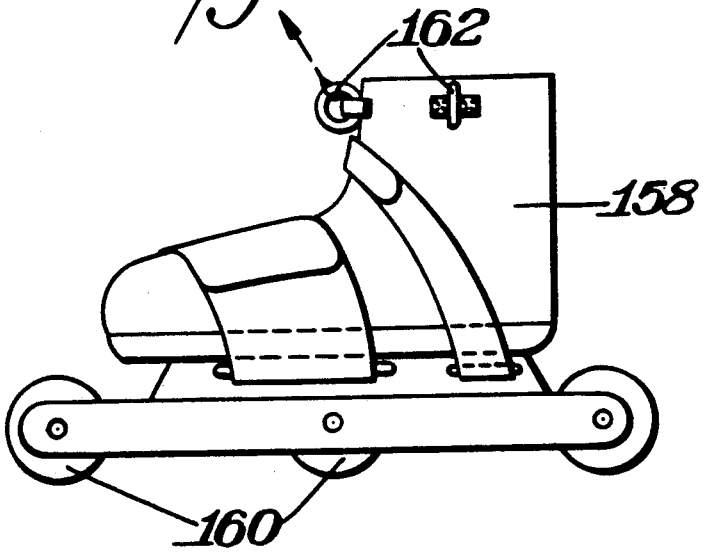

FIGS. 12–14 show various types of footwear which may be utilized in the practice of this invention. FIG. 12 illustrates a form of shoe 146 having a series of loops or eyelets 148 to which the cords may be fastened. Alternatively a loop may be fastened to tab 149. Shoe 146 may be attached to the foot in any suitable manner, such as by adjustable straps 150.

FIG. 13 illustrates a variation wherein a spat or band 152 is disposed around shoe 154 with spat or band 152 having its own fastening loops 156 for attachment of the cord.

FIG. 14 exemplifies how the invention could be used with special types of exercise footwear. As shown therein the shoe 158 includes roller blades 160 for use in a roller blade type exercise. A series of loops 162 are provided for attachment of the cord. Similarly, the shoes may include ice skates, roller skates, spikes, cleats or any other form of specialized shoe or footwear used for a particular exercise.

Figure 15:
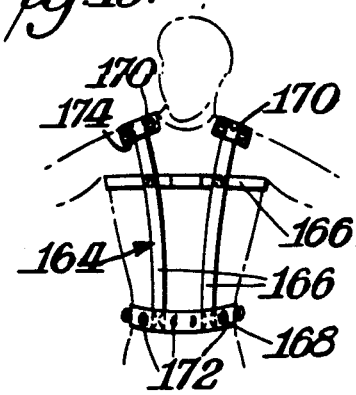
FIG. 15 is a front elevational view of a harness in accordance with this invention.

FIG. 15 illustrates a further variation of the invention wherein a harness 164 is used as the article of clothing for attachment of the loops. As shown harness 164 includes a plurality of straps 166 for fitting around the body. Additionally, a belt section 168 is provided as well as shoulder sections 170 which are padded for comfort. The belt 168 and shoulder sections 170 includes loops or other fastening devices 172, 174 as previously described. Harness 164 could be worn directly over an exercise garment, such as suit, sweatshirt, etc. or could be worn beneath the garment with the cords extending outwardly for anchoring the hands and/or feet as previously described. Harness 164 could also be located between layers of a multi-layer suit.

Figure 16:
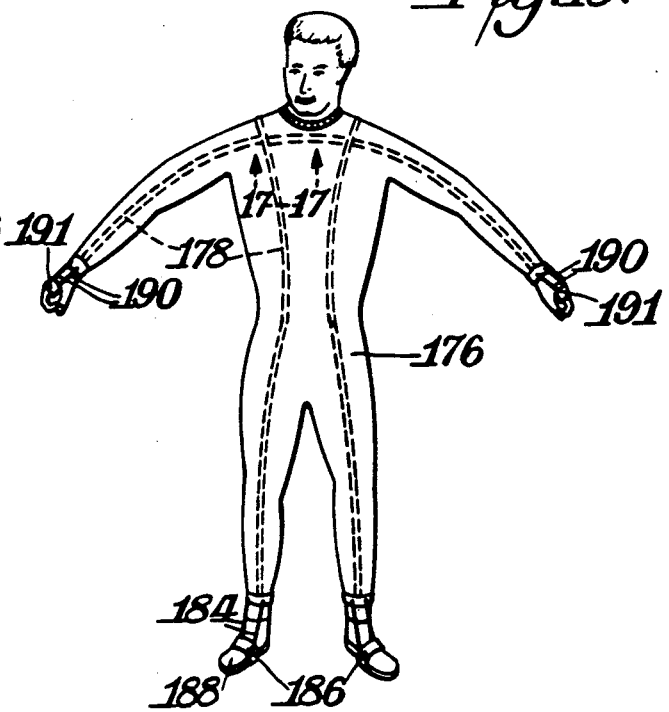
FIG. 16 is a front elevational view of a body suit in accordance with this invention.
Figure 17:
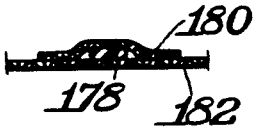
FIG. 17 is a cross-sectional view taken through FIG. 16 along the line 17—17.
Figure 18:
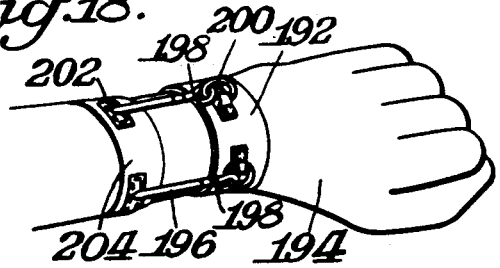
FIG. 18 is a perspective view showing the detachable fastening means on an enlarged scale for the suit shown in FIGS. 16.

FIGS. 16–18 illustrate yet another practice of the invention which includes a one piece suit 176. Suit 176 includes elastic cords 178 which may be mounted beneath or above the suit, preferably however, cords 178 are formed within the suit by being disposed between individual layers 180, 182 as illustrated in FIG. 17. Suit 176 differs from the prior art resistance suit which incorporates long thin rubber bands in that suit 170 includes anchor members at the limb extremities. For example, FIG. 16 illustrates the ends of the leg portion of suit 176 to include cords 184 secured to loop or band 186 which fits around the feet or shoes 188. Similarly, the ends of the arm sections of suit 176 include cords 190 which are anchored to loops 191 disposed around the fingers in a manner similar to that illustrated in FIG. 8. FIG. 18 illustrates an alternative form of connection of the arm sections of suit 176 by having non-elastic connectors 196 formed with hook ends 198 secured through loops 200 on bands or cuffs 192 of gloves 194 with the opposite ends of connectors 196 being permanently fixed at 202 to the cuff portion 204 of suit 176.

The embodiment of FIG. 16 could be in practiced wherein the full body suit 176 includes adjustable size loops at the ends of the arms and leg portions. Additionally, the anchor members for the full body suit 176 could include gloves and shoes with cords 178 attached thereto or with the gloves or shoes being integral. As illustrated in FIG. 16 the cords extend throughout the main body portion and the arms and leg sections of the suit 176.

Figure 19:
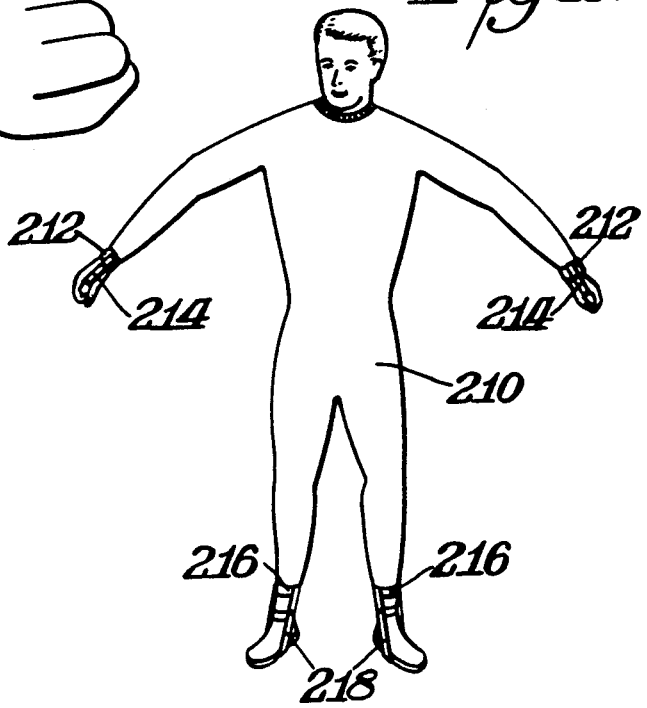
FIG. 19 is a front elevational view of yet another bodysuit in accordance with this invention.

FIG. 19 illustrates yet another variation of this invention wherein a full body suit 10 is made of elastic material, thus avoiding the need to incorporate elastic cords or strips in the body suit. As illustrated in FIG. 19 the cuffs 212 at the ends of the arms have a loop or strap 214 attached thereto for wrapping around the hands. Strap 214 may be made of adjustable length, such as by the inclusion of velcro fasteners so as to give proper dimensioning and thereby assure an effective anchoring at the hands. Similarly, the ankles include bands 216 at the ends of the leg sections which likewise include straps or loops 218 which would be similar to straps or loops 214 in the sense of being adjustable in length for wrapping around the user's shoes or feet.

Figure 20:
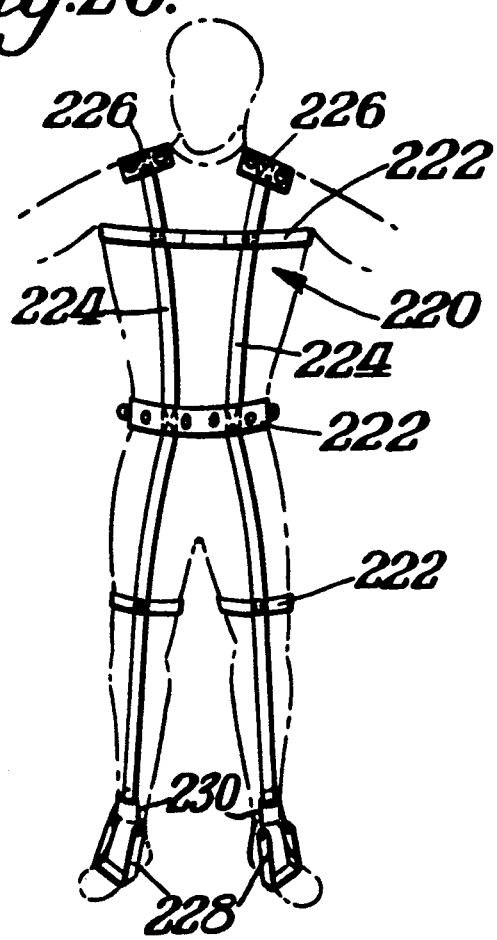
FIG. 20 is a front elevational view of a full body harness in accordance with this invention.

FIG. 20 illustrates a variation similar to FIG. 15 except that the harness 220 is a full body harness having suitably located horizontal straps 222 at the chest, waist and thighs with interconnecting vertical straps 224 and having padded shoulders 226. Full body harness 220 is similar to the harness in FIG. 15 in that it would also include loops or fasteners for securement of elastic cords to the hands and legs and other parts of the harness. FIG. 20, for example, illustrates loops or straps 228 being connected by cords 230 with the loops 228 extending around the user's feet.

It is to be understood that an advantage of the invention, particularly where various connectors are provided at various parts of the body suit is to enable the user to selectively locate elastic cords when it is desired to enhance particular exercises. Thus, for example, with reference to FIG. 5, by the appropriate fastening of cords it is possible to use the same device for achieving upper body exercise alone, lower body exercise alone or total body exercise.

The different variations of the invention thereby range from very simple basic forms, such as the wrist and arm bands with interconnecting cords of FIG. 1 or the full body elastic suit with arm and leg loops in FIG. 19 to more complicated structures which provide greater versatility in exercise selection. The versatility would be achieved by garments having connectors suitably located at various portions for selective attachment of elastic cords thereby permitting the same structure to be used to provide a variety of different resistance exercises in accordance with the needs and desires of the user.

It is to be understood that while the invention is preferably practiced with the limb anchoring members being in the form of footwear or gloves, the invention may also be broadly practiced by the use of ankle bands or wrist bands. Such ankle bands or wrist bands, however, are not as preferable since there would be a greater tendency for some sliding movement up or down the legs or arms which is prevented when the invention is practiced by the use of shoes or gloves or by hand bands or spats which fit over the feet or hands.

It is also to be understood that the specific features described in various specific embodiments may be used in other embodiments.

As can be appreciated the aerobic resistance exercise garment of this invention provides an effective supplemental exercise to main motion aerobic exercises. Such main exercises could include, for example, walking, jogging, stepping, cycling, aerobics, warm-ups, skating, hiking, weight training, skiing, and mountain climbing.

What is claimed is:

1. An aerobic resistance exercise garment to supplement motion exercises comprising an article of clothing worn on the body of the user, said article of clothing including a body portion, a pair of gloves to be worn on the hands of the user, each of said gloves including a palm portion extending to at least the fingers and including a closed loop wrist portion, a pair of feet portions each of which is to be worn on a foot of the user, a pair of anchor members remote from said feet portions, a plurality of elastic cords, each of said cords having two free ends with an intermediate portion, said plurality of cords being arranged in at least two sets of cords, one of said sets of cords comprising at least one cord having one of its free ends attached to a respective one of said gloves at its said wrist portion and the other of its free ends attached to the other of said gloves at its said wrist portion with said intermediate portion of said cord extending through first guides means on said body portion whereby said cord elastically interconnects said gloves to each other to provide resistance to arm movement of the user, and the second set of said cords comprising two cords with each of said cords being attached at one of its free ends to a respective one of said anchor members and being attached are the other of its free ends to a respective one of said feet portions and with its intermediate portion extending through second guide means on said body portion of said clothing whereby each of said elastic cords of said second set elastically interconnects a respective one of said anchor members with a respective one of said feet portions to provide resistance during relative movement between a respective arm and leg of the user.

2. The garment of claim 1 wherein said gloves further comprise said anchor members.

3. The garment of claim 1 wherein said body portion comprises shoulder portions and said anchor members are located at the shoulder portions of said article of clothing.

4. The garment of claim 3 wherein said second set of said cords extend the full length of said article of clothing from the feet portions to the shoulders portions along the back side thereof.

5. The garment of claim 4 including a third set of cords extending from said feet portions to said gloves through third guide means.

6. The garment of claim 5 wherein each of said sets of cords includes a mirror image set of cords with a set of cords extending along the back side and its mirror image set extending along the front side of the garment.

7. The garment of claim 6 wherein said body portion comprises a waist portion and said second and said third guide means are located around the waist portion of said article of clothing.

8. The garment of claim 1 wherein said feet portions are shoes.

9. An aerobic resistance exercise garment to supplement motion exercises comprising an article of clothing worn on the body of the user, said article of clothing including a body portion, a pair of shoes to be worn on the feet of the user, a plurality of spaced connecting members secured to and around each of said shoes, a pair of anchor members to be worn by the user at locations remote from said shoes, each of said anchor members having a plurality of spaced connecting means, a plurality of guide means spaced around said body portion, a plurality of elastic cords, each of said cords having two free ends with an intermediate portion, each of said free ends having a fastening member, each of said cords being detachably attached at one of its said free ends to a respective one of said shoes by its said fastening member being detachably selectively secured to one of said shoe connecting members with at least one other shoe connecting member having no cord attached thereto, the other of said free ends of each of said cords being selectively detachably attached to a respective one of said anchor members by its said fastening member being detachably secured to one of said anchor member connecting means with at least one other anchor member connecting means having no cord attached thereto, and said intermediate portion of each of said cords selectively extending through one of said guide means on said body portion of said clothing with at least one other of said guide means having no cord extending therethrough whereby each of said elastic cords detachably elastically interconnects a respective one of said shoes with said body portion to provide resistance to leg movement of the user and to permit ready replacement by a different elastic cord to vary the resistance in accordance with the selection of said connecting member and said guide means and said connecting means for each of said cords.

10. The garment of claim 9 wherein said body portion comprises shoulder portions and said anchor members are located at the shoulder portions of said article of clothing.

11. The garment of claim 10 wherein each of said cords extends the length of the garment from said shoes to said shoulder portions along the backside thereof.

12. The garment of claim 11 wherein a second set of said cords extends from said shoes to said shoulder portions along the front side thereof.

13. The garment of claim 12 wherein said shoulder portions are padded.

14. The garment of claim 9 wherein each of said anchor members is a glove having a palm portion extending to at least the fingers and having a closed loop wrist portion, said connecting means being located at said wrist portion.

15. The garment of claim 14 including a second set of cords extending from one of said gloves to the other of said gloves at said wrist portions thereof and through second guide means on said body portion of said article of clothing.

16. An aerobic resistance exercise garment to supplement motion exercises comprising an article of clothing worn on the body of the user, said article of clothing including a body portion, a pair of gloves to be worn on the hands of the user, each or said gloves including a palm portion extending to at least the fingers and including a closed loop wrist portion, a plurality of connecting members secured to each of said wrist portions, a pair of anchor members, each of said anchor members having a plurality of spaced connecting means, guide means on said body member, at least one elastic cord, said cord having two free ends with an intermediate portion, each of said free ends having a fastening member, said cord being detachably attached at one of its said free ends to a respective one of said gloves by its said fastening member being detachably secured to said wrist connecting member and being detachably attached at the other of its free ends to a respective one of said anchor members by its said fastening member being detachably secured to said anchor member connecting means, and said intermediate portion of each of said cords extending through guide means on said body portion of said clothing to provide resistance to arm movement of the user and to permit ready replacement by a different elastic cord to vary the resistance.

17. The garment of claim 16 wherein said gloves further comprise said anchor members whereby said cord interconnects one of said gloves with the other of said gloves.

18. The garment of claim 16 wherein said anchor members are a pair of shoes and comprising two of said cords interconnecting each of said gloves with a respective one of said shoes.

19. The garment of claim 18 including a further one of said cords interconnecting said gloves to each other through a further guide means.

* * * * *